US010448726B2

(12) United States Patent
Lin

(10) Patent No.: US 10,448,726 B2
(45) Date of Patent: Oct. 22, 2019

(54) COSMETIC CONTAINER

(71) Applicant: LIBO COSMETICS CO., LTD., Changhua County (TW)

(72) Inventor: Hsiao-Yun Lin, Changhua County (TW)

(73) Assignee: LIBO COSMETICS CO., LTD., Lukang Township, Changhua County (TW)

( * ) Notice: Subject to any disclaimer, the term of this patent is extended or adjusted under 35 U.S.C. 154(b) by 59 days.

(21) Appl. No.: 15/790,608

(22) Filed: Oct. 23, 2017

(65) Prior Publication Data

US 2018/0352935 A1 Dec. 13, 2018

Related U.S. Application Data

(60) Provisional application No. 62/517,475, filed on Jun. 9, 2017.

(51) Int. Cl.

| | |
|---|---|
| ***A45D 40/24*** | (2006.01) |
| ***A45D 40/26*** | (2006.01) |
| ***A45D 34/04*** | (2006.01) |
| *A45D 40/00* | (2006.01) |
| *A45D 34/00* | (2006.01) |

(52) U.S. Cl.

CPC ..... *A45D 40/24* (2013.01); *A45D 34/046* (2013.01); *A45D 40/267* (2013.01); *A45D 2034/007* (2013.01); *A45D 2040/0012* (2013.01)

(58) Field of Classification Search

CPC ..... B29C 65/083

USPC ... 220/62.14, 253, 254.9, 254.7, 501, 23.91, 220/503–4, 601, 23.89, 23.87; 401/118, 401/75, 55, 68, 65, 173, 9, 95, 195, 31, 401/60, 16, 126; 206/56, 219; 222/327; 132/318, 317, 297; 29/DIG. 48, 166, 29/469, 428; 141/23; 156/73.5, 60, 73.1, 156/293, 294

See application file for complete search history.

(56) References Cited

U.S. PATENT DOCUMENTS

| | | | | |
|---|---|---|---|---|
| 3,080,989 A * | 3/1963 | Ramsbotham | B65D 83/384 | 215/12.1 |
| 3,775,904 A * | 12/1973 | Peters | A01G 27/06 | 215/12.1 |
| 4,371,087 A * | 2/1983 | Saujet | A45D 34/02 | 215/12.1 |

(Continued)

FOREIGN PATENT DOCUMENTS

| | | |
|---|---|---|
| CN | 2705404 Y | 6/2005 |
| CN | 101518389 A | 9/2009 |

(Continued)

OTHER PUBLICATIONS

Office Action dated Aug. 3, 2018 for corresponding TW Application 106143697, and partial English translation thereof.

*Primary Examiner* — J. Gregory Pickett
*Assistant Examiner* — Tia Cox
(74) *Attorney, Agent, or Firm* — Muncy, Geissler, Olds & Lowe, P.C.

(57) ABSTRACT

A cosmetic container includes an outer shell and an inner shell. The outer shell includes a sidewall, and the sidewall includes a plurality of perforated holes. The inner shell is inserted into the outer shell, wherein the inner shell includes a body and a plurality of protruding patterns extending outwardly and exposed through the perforated holes.

17 Claims, 22 Drawing Sheets

(56) References Cited

U.S. PATENT DOCUMENTS

| | | | | |
|---|---|---|---|---|
| 4,544,063 | A * | 10/1985 | Neward | B65D 47/263 206/528 |
| 5,299,700 | A * | 4/1994 | Beniacar | B65D 23/0857 206/485 |
| 6,341,712 | B1 | 1/2002 | Huang | |
| 6,450,179 | B2 * | 9/2002 | Bengis | A45D 40/18 132/297 |
| 6,915,554 | B2 * | 7/2005 | Yang | B29C 39/023 264/245 |
| 8,113,350 | B2 * | 2/2012 | Sanchez | A45D 40/00 132/297 |
| 8,662,775 | B1 * | 3/2014 | Liu | A45D 40/04 401/17 |
| 9,247,801 | B2 * | 2/2016 | Presche | A45D 40/268 |
| 9,387,976 | B2 * | 7/2016 | Geis | B65D 83/384 |
| 2004/0245249 | A1 | 12/2004 | Liu | |
| 2012/0267398 | A1 * | 10/2012 | Lim | A45D 34/04 222/256 |
| 2014/0348566 | A1 * | 11/2014 | Uehara | A45D 34/046 401/126 |
| 2016/0037890 | A1 * | 2/2016 | Chen | B05B 11/0032 222/154 |

FOREIGN PATENT DOCUMENTS

| | | |
|---|---|---|
| TW | M242058 | 9/2004 |
| TW | M307997 U | 3/2007 |
| TW | M490789 | 12/2014 |
| TW | M513850 | 12/2015 |

* cited by examiner

COSMETIC CONTAINER

PRIORITY CLAIM AND CROSS-REFERENCE

This application claims priority of U.S. provisional application Ser. No. 62/517,475 filed on Jun. 9, 2017, which is incorporated by reference in its entirety.

TECHNICAL FIELD

The present disclosure relates to a cosmetic container, and more particularly, to a cosmetic container with aesthetic appearance.

DISCUSSION OF THE BACKGROUND

Cosmetic products such as lipstick, lip gloss or the like are broadly used to make people more beautiful, attractive and impressive. The appearance of cosmetic products, however, needs to be more fashionable to meet the aesthetic tastes of customers.

SUMMARY

One aspect of the present disclosure provides a cosmetic container with aesthetic appearance.

A cosmetic container according to some embodiments of the present disclosure includes a housing and a bottle. The housing includes an outer shell and an inner shell. The outer shell includes a sidewall, and the sidewall includes a plurality of perforated holes. The inner shell is inserted into the outer shell, wherein the inner shell includes a body and a plurality of protruding patterns extending outwardly and exposed through the perforated holes. The bottle is inserted into the inner shell, wherein the body of the inner shell is expanded by the bottle such that the protruding patterns of the inner shell engage with the perforated holes.

In some embodiments, an outer surface of the sidewall of the outer shell and outer surfaces of the protruding patterns of the inner shell are coplanar.

In some embodiments, outer surfaces of the protruding patterns of the inner shell are protruded out from an outer surface of the sidewall of the outer shell.

In some embodiments, the bottle is bonded to the body of the inner shell.

In some embodiments, the bottle is bonded to the body of the inner shell by ultrasonic welding.

In some embodiments, the bottle is bonded to the sidewall of the outer shell.

In some embodiments, the bottle is bonded to the sidewall of the outer shell by ultrasonic welding.

In some embodiments, the body of the inner shell is a one-piece body comprising a plurality of body sections with the protruding patterns formed thereon, and a resilient section between and connected to the body sections.

In some embodiments, the resilient section comprises a herringbone-pleated structure.

In some embodiments, the body of the inner shell is a multi-piece body comprising a plurality of body sections with the protruding patterns formed thereon, and the plurality of body sections are separated from each other.

In some embodiments, the outer shell and the inner shell are formed from different materials.

A cosmetic container of the present disclosure includes a base and two caps. The base has a first open end and a second open end opposite to each other for receiving two separate cosmetic products. The two caps are configured to cover the first open end and the second open end of the base, respectively. Each of the two caps has an open end, and the open ends of the two caps are detachably engageable with the first open end and the second open end of the base, respectively. Each of the two caps includes an outer shell and an inner shell. The outer shell includes a sidewall, and the sidewall includes a plurality of perforated holes. The inner shell is inserted into the outer shell, wherein the inner shell includes a body and a plurality of protruding patterns extending outwardly and exposed through the perforated holes.

In some embodiments, an outer surface of the sidewall of the outer shell and outer surfaces of the protruding patterns of the inner shell of each of the two caps are coplanar.

In some embodiments, outer surfaces of the protruding patterns of the inner shell of each of the two caps are protruded out from an outer surface of the sidewall of the outer shell.

In some embodiments, each of the two caps further comprises a cover plate affixed to the outer shell and the inner shell, forming a closed end in the cap.

In some embodiments, each of the cover plates includes a plurality of recesses, and each of the inner shells includes a plurality of projections engaged with the recesses of the cover plate such that each of the cover plates is affixed to the inner shell.

In some embodiments, each of the cover plates is affixed to the respective outer shell with adhesives.

In some embodiments, the outer shell and the inner shell are formed from different materials.

In some embodiments, the inner shell is formed from a resilient material, and the inner shell includes a plurality of slots configured to reduce a size of the inner shell for fitting the inner shell into the outer shell.

The foregoing has outlined rather broadly the features and technical advantages of the present disclosure in order that the detailed description of the disclosure that follows may be better understood. Additional features and advantages of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes as those of the present disclosure. It should also be realized by those skilled in the art that such equivalent constructions do not depart from the spirit and scope of the disclosure as set forth in the appended claims.

BRIEF DESCRIPTION OF THE DRAWINGS

A more complete understanding of the present disclosure may be derived by referring to the detailed description and claims when considered in connection with the Figures, where like reference numbers refer to similar elements throughout the Figures, and:

DETAILED DESCRIPTION

The following description of the present disclosure accompanies drawings, which are incorporated in and constitute a cosmetic container of this specification, and illustrate embodiments of the disclosure, but the disclosure is not limited to the embodiments. In addition, the following embodiments can be properly integrated to complete another embodiment.

References to "one embodiment," "an embodiment," "exemplary embodiment," "some embodiments," "other embodiments," "another embodiment," etc. indicate that the embodiment(s) of the disclosure so described may include a particular feature, structure, or characteristic, but not every embodiment necessarily includes the particular feature, structure, or characteristic. Further, repeated use of the phrase "in the embodiment" does not necessarily refer to the same embodiment, although it may.

In order to make the present disclosure completely comprehensible, detailed steps and structures are provided in the following description. Obviously, implementation of the present disclosure does not limit special details known by persons skilled in the art. In addition, known structures and steps are not described in detail, so as not to limit the present disclosure unnecessarily. Preferred embodiments of the present disclosure will be described below in detail. However, in addition to the detailed description, the present disclosure may also be widely implemented in other embodiments. The scope of the present disclosure is not limited to the detailed description, and is defined by the claims.

Figure 1:
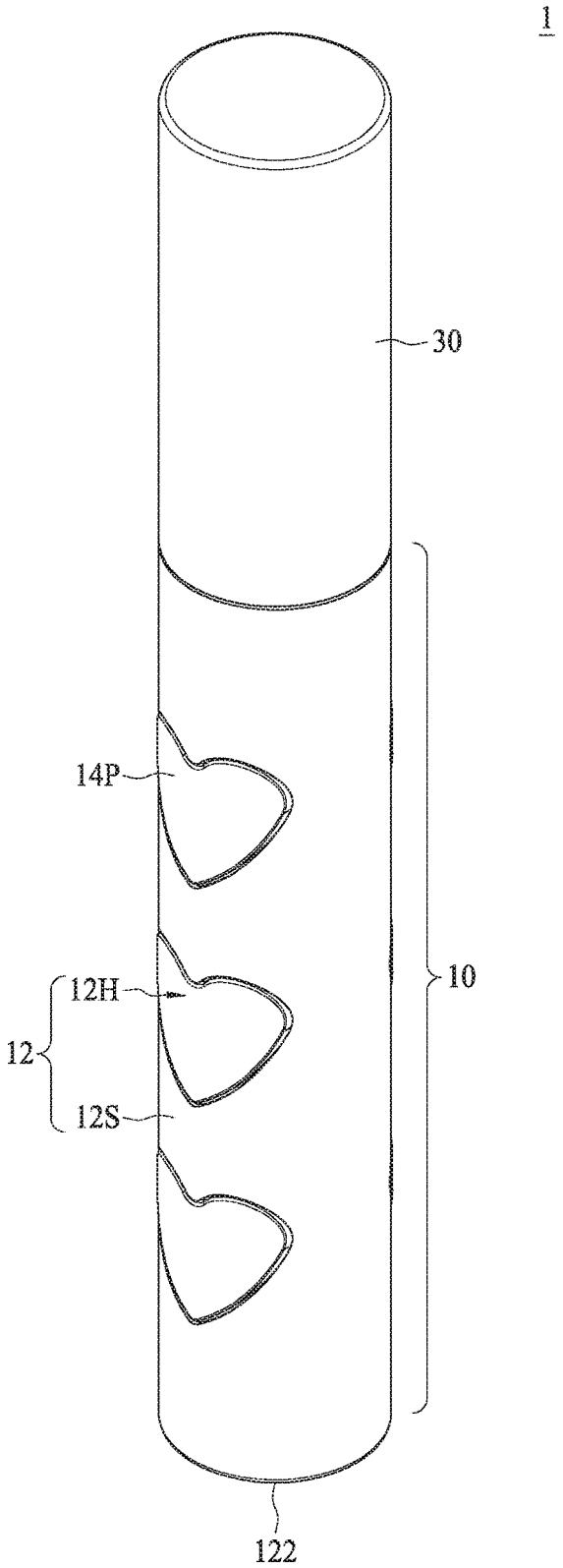
FIG. 1 is a schematic perspective view of a cosmetic container in accordance with some embodiments of the present disclosure.
Figure 1A:
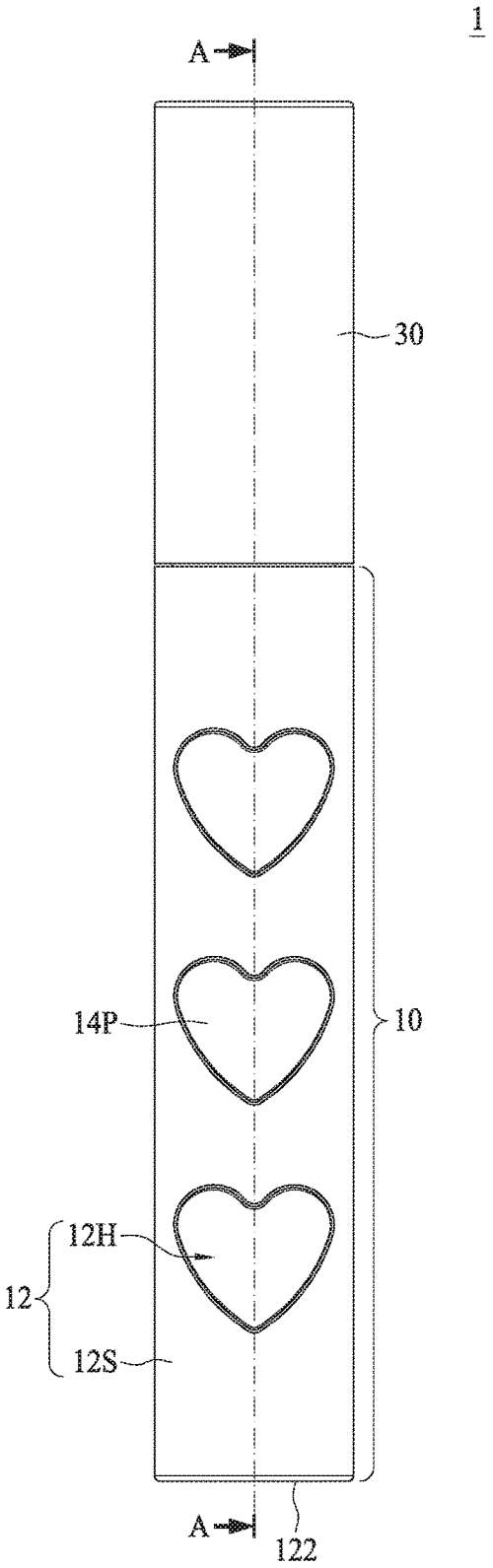
FIG. 1A is a schematic side view of a cosmetic container in accordance with some embodiments of the present disclosure.
Figure 1B:
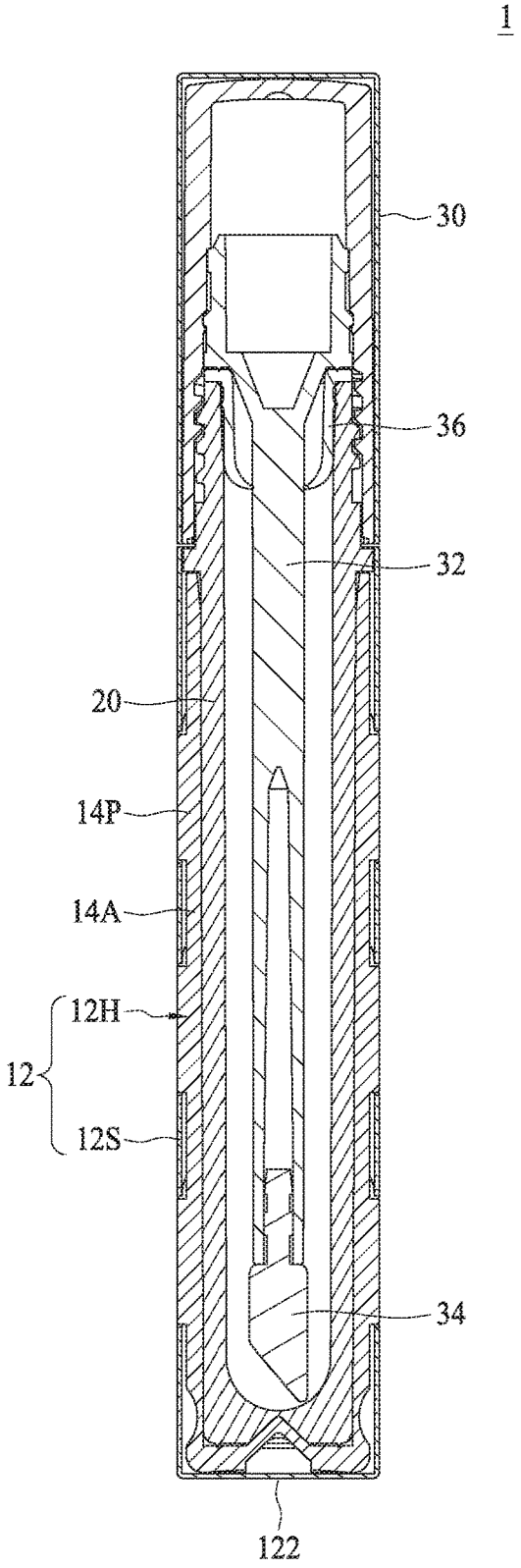
FIG. 1B is a schematic cross-sectional view of a cosmetic container along line A-A of FIG. 1A in accordance with some embodiments of the present disclosure.
Figure 1C:
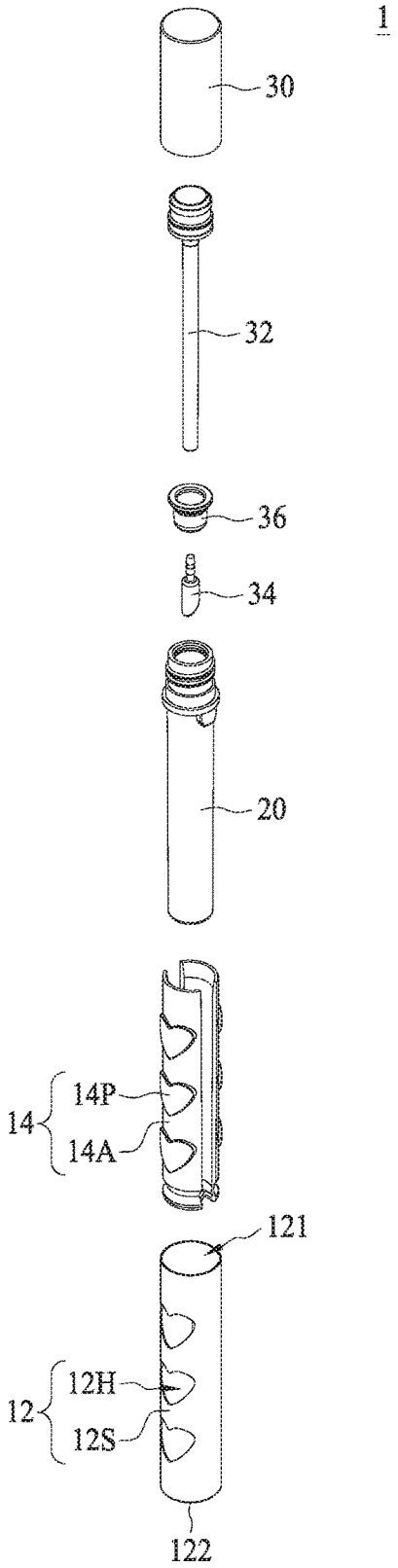
FIG. 1C is a schematic exploded view of a cosmetic container in accordance with some embodiments of the present disclosure.
Figure 2:
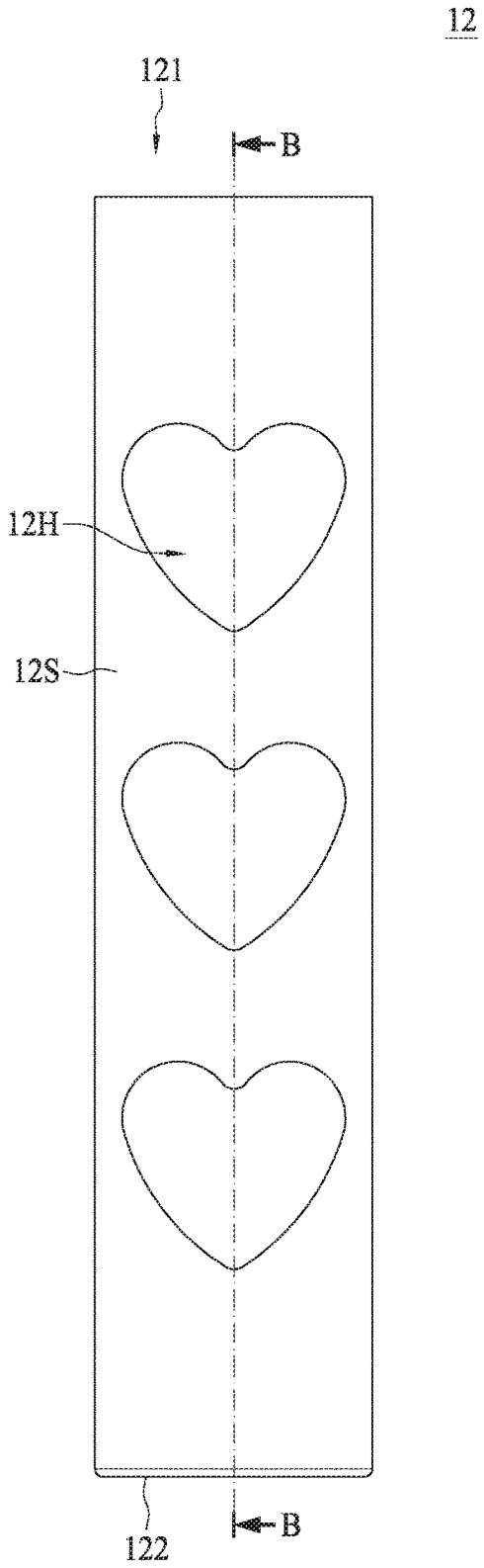
FIG. 2 is a schematic side view of an outer shell in accordance with some embodiments of the present disclosure.
Figure 2A:
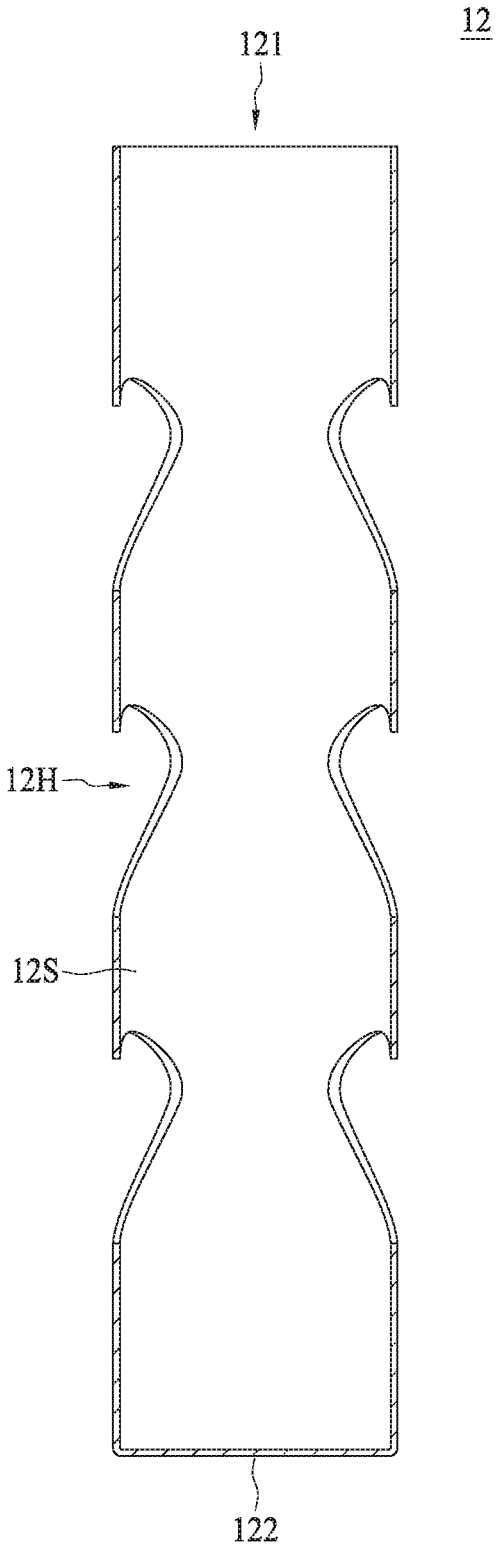
FIG. 2A is a schematic cross-sectional view of an outer shell along line B-B of FIG. 2 in accordance with some embodiments of the present disclosure.
Figure 3:
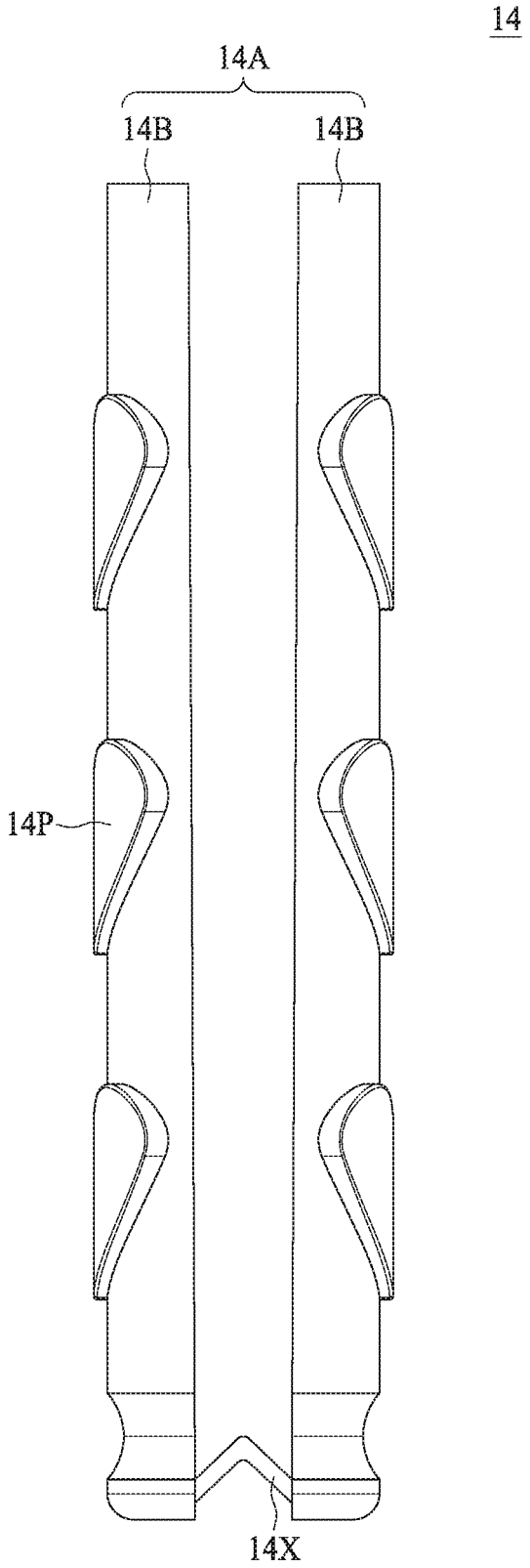
FIG. 3 is a schematic side view of an inner shell from a direction in accordance with some embodiments of the present disclosure.
Figure 3A:
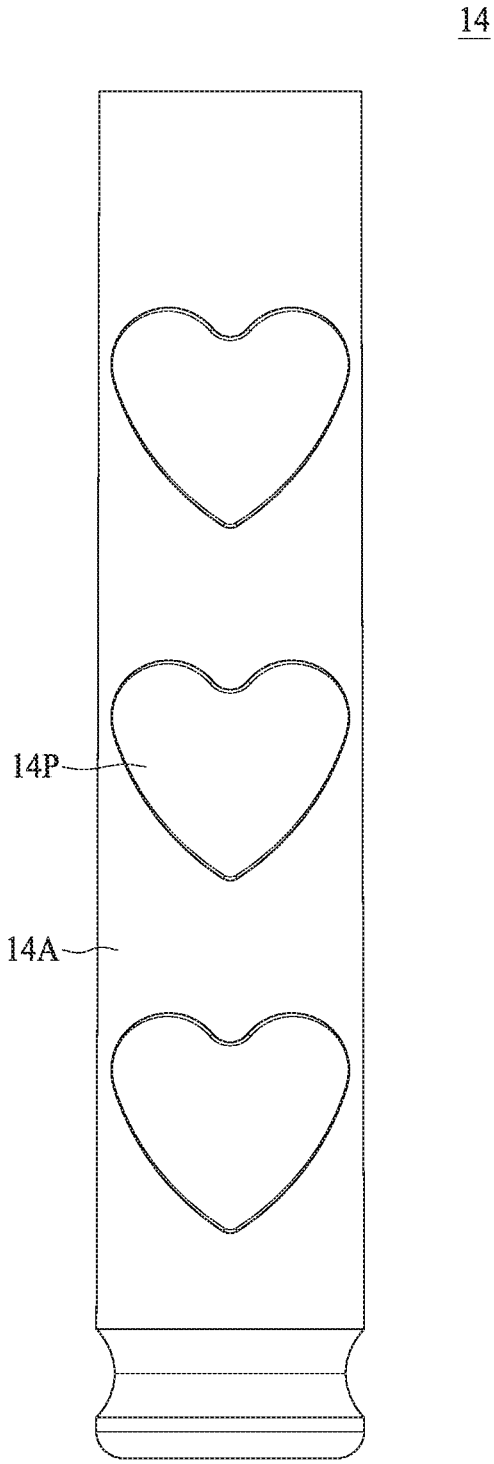
FIG. 3A is a schematic side view of an inner shell from another direction in accordance with some embodiments of the present disclosure.
Figure 3B:
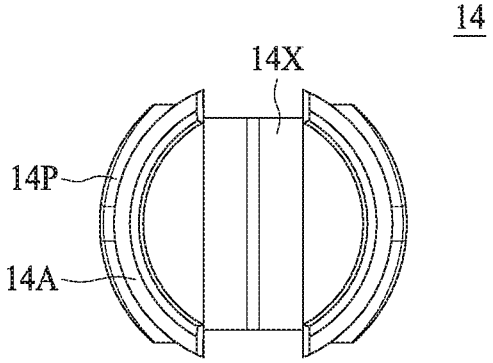
FIG. 3B is a schematic bottom view of an inner shell in accordance with some embodiments of the present disclosure.
Figure 4:
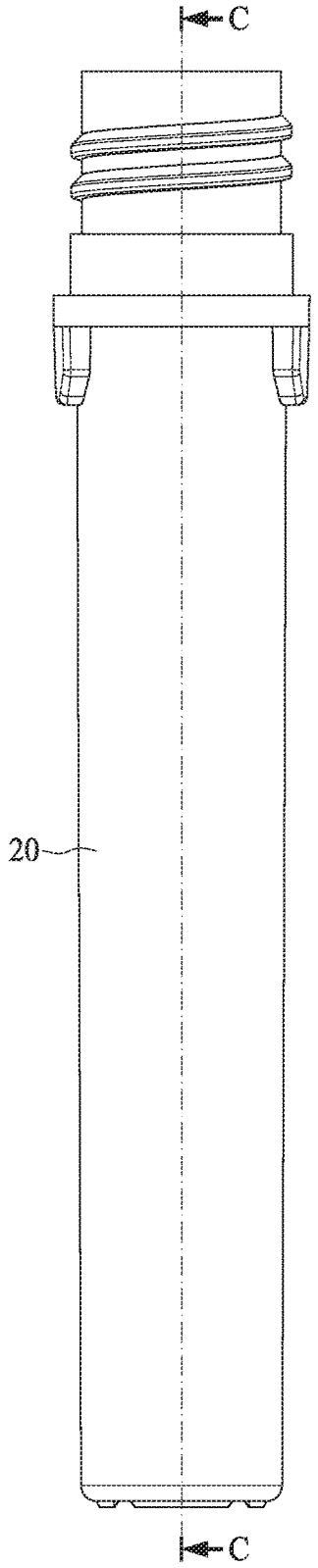
FIG. 4 is a schematic side view of a bottle in accordance with some embodiments of the present disclosure.
Figure 4A:
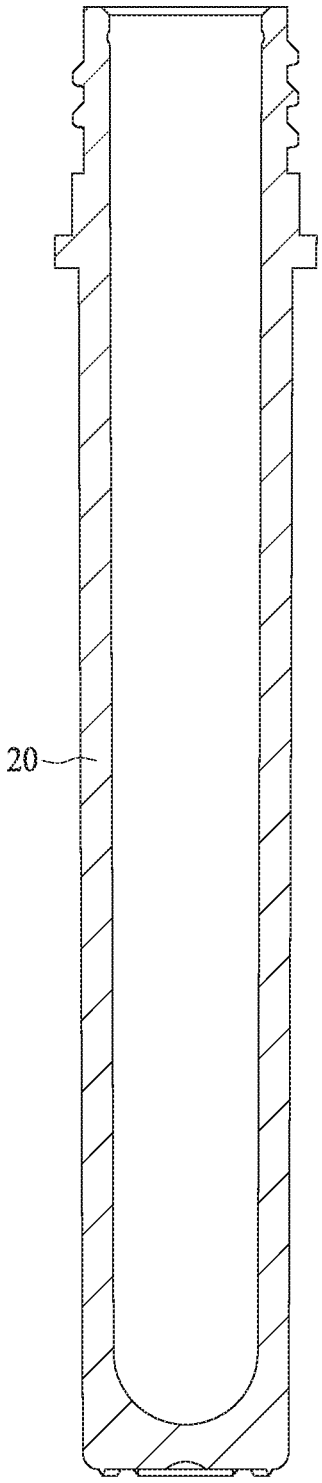
FIG. 4A is a schematic cross-sectional view of a bottle along line C-C of FIG. 4 in accordance with some embodiments of the present disclosure.

Refer to FIG. 1, FIG. 1A, FIG. 1B, FIG. 1C, FIG. 2, FIG. 2A, FIG. 3, FIG. 3A, FIG. 3B, FIG. 4 and FIG. 4A. FIG. 1 is a schematic perspective view of a cosmetic container in accordance with some embodiments of the present disclosure; FIG. 1A is a schematic side view of a cosmetic container in accordance with some embodiments of the present disclosure; FIG. 1B is a schematic cross-sectional view of a cosmetic container along line A-A of FIG. 1A in accordance with some embodiments of the present disclosure; FIG. 1C is a schematic exploded view of a cosmetic container in accordance with some embodiments of the present disclosure; FIG. 2 is a schematic side view of an outer shell in accordance with some embodiments of the present disclosure; FIG. 2A is a schematic cross-sectional view of an outer shell along line B-B of FIG. 2 in accordance with some embodiments of the present disclosure; FIG. 3 is a schematic side view of an inner shell from a direction in accordance with some embodiments of the present disclosure; FIG. 3A is a schematic side view of an inner shell from another direction in accordance with some embodiments of the present disclosure; FIG. 3B is a schematic bottom view of an inner shell in accordance with some embodiments of the present disclosure; FIG. 4 is a schematic side view of a bottle in accordance with some embodiments of the present disclosure; and FIG. 4A is a schematic cross-sectional view of a bottle along line C-C of FIG. 4 in accordance with some embodiments of the present disclosure. The cosmetic container 1 includes a housing 10 and a bottle 20. The housing 10 includes an outer shell 12 and an inner shell 14. In some embodiments, the outer shell 12 includes a sidewall 12S, and the sidewall 12S includes a plurality of perforated holes 12H penetrating through the sidewall 12S. In some embodiments, the outer shell 12 includes a tubular shell of hollow construction such as a cylindrical shell or the like. The outer shell 12 may have an open end 121 configured to receive the inner shell 14 and the bottle 20, and a closed end 122 opposite to the open end 121.

The inner shell 14 includes a body 14A and a plurality of protruding patterns 14P extending outwardly from the body 14A. The inner shell 14 may be inserted into the outer shell 12 through the open end 121, and the protruding patterns 14P may protrude into and be exposed through the perforated holes 12H when the inner shell 14 is inserted into the outer shell 12. The shape and number of the protruding patterns 14P are identical to those of the perforated holes 12H such that the protruding patterns 14P of the inner shell 14 can protrude into and engage with the perforated holes 12H of the outer shell 12. By way of example, the shape of the protruding pattern 14P may be heart shape, but is not limited thereto. In some embodiments, different protruding patterns 14P may have different patterns. In some embodiments, the outer shell 12 and the inner shell 14 are formed from different materials to produce a desired visual effect. In some embodiments, the material of the outer shell 12 may be formed from an opaque material such as aluminum or other metal material. In some embodiments, the material of the inner shell 14 may be formed from a transparent material or an opaque material. For example, the material of the inner shell 14 may include plastic. In some embodiments, the outer shell 12 and the inner shell 14 may have different colors to produce a desired visual effect. In some embodiments, the protruding patterns 14P of the inner shell 14 may be formed from a fluorescent or a phosphorous material to produce a glimmer visual effect. In some embodiments, the protruding patterns 14P of the inner shell 14 may be formed from an optical material to produce a three-dimensional (3D) visual effect. In some embodiments, the inner shell 14 may be replaceable such that the customer can select different inner shells 14 to meet different requirements. For example, the customer can select different inner shells 14 to fit the customer's outfit or accessories.

In some embodiments, the body 14A of the inner shell 14 may be a one-piece body including a plurality of body sections 14B with the protruding patterns 14P formed thereon. In some embodiments, the body 14A of the inner shell 14 may further include a resilient section 14X between and connected to the body sections 14B. The resilient section 14X may be disposed at one end of the body 14A and may be compressible, and thus the inner shell 14 can be inserted into the outer shell 12. By way of example, the resilient section 14X may include a herringbone-pleated structure, which can be compressed or pleated when the inner shell 14 is inserted into the outer shell 12. In some embodiments, the herringbone-pleated structure may have a V-shaped cross-sectional shape, a W-shaped cross-sectional shape or the like when the herringbone-pleated structure is compressed or pleated. The herringbone-pleated structure can be restored or extended after the inner shell 14 reaches the bottom of the outer shell 12 such that the protruding patterns 14P can protrude into the perforated holes 12H of the outer shell 12. In some embodiments, the herringbone-pleated structure may have an I-shaped cross-sectional shape when the herringbone-pleated structure is extended.

The bottle 20 is configured to contain a cosmetic material 16 such as lip gloss, mascara, concealer, liquid foundation or the like. The bottle 20 may be inserted into the inner shell 14. In some embodiments, when the bottle 20 is inserted into the inner shell 14, the body 14A of the inner shell 14 may be expanded by the bottle 20 such that the protruding patterns 14P of the inner shell 14 protrude into and engage with the perforated holes 12H of the outer shell 12. In some embodiments, the height of the protruding patterns 14P may be identical to the depth of the perforated holes 12H such that the outer surface of the sidewall 12S of the outer shell 12 and outer surfaces of the protruding patterns 14P of the inner shell 14 are coplanar so as to avoid injury and provide comfortable texture. In some alternative embodiments, the outer surfaces of the protruding patterns 14P of the inner shell 14 may be protruded out from the outer surface of the sidewall 12S of the outer shell 12 so as to provide a desired visual effect.

In some embodiments, a portion of the bottle 20 may be in contact with the body 14A of the inner shell 14, and the bottle 20 may be bonded to the body 14A of the inner shell 14 such that the bottle 20 may be affixed to the inner shell 14. By way of example, the bottle 20 is bonded to the body 14A of the inner shell 14 by ultrasonic welding or other bonding techniques. In some embodiments, a portion of the bottle 20 may be in contact with the sidewall 12S of the outer shell 12, and the bottle 20 may be bonded to the sidewall 12S of the outer shell 12 such that the bottle 20 may be affixed to the outer shell 12. By way of example, the bottle 20 is bonded to the sidewall 12S of the outer shell 12 by ultrasonic welding or other bonding techniques.

In some embodiments, the cosmetic container 1 may further include a cap 30, a rod 32 and a doe foot 34. The cap 30 is configured to cover and seal the bottle 20. In some embodiments, the inner surface of the cap 30 and the outer surface of the bottle 20 may have a locking mechanism such that the cap 30 may be secured to the bottle 20. By way of example, the locking mechanism may include screw threads, projections and grooves, or other suitable locking structures. In some embodiments, the rod 32 may include one end affixed to the cap 30, and the other end inserted into the bottle 20 when the cap 30 covers the bottle 20. In some embodiments, the doe foot 34 is affixed to the other end of the rod 32, and the doe foot 34 is configured to dip into the cosmetic material in the bottle 20. In some embodiments, the cosmetic container 1 may further include a wiper 36 disposed inside the bottle 20 and near the opening of the bottle 20. The wiper 36 is configured to remove excessive cosmetic material from the doe foot 34 when the doe foot 34 is pulled out of the bottle 20.

Figure 5A:
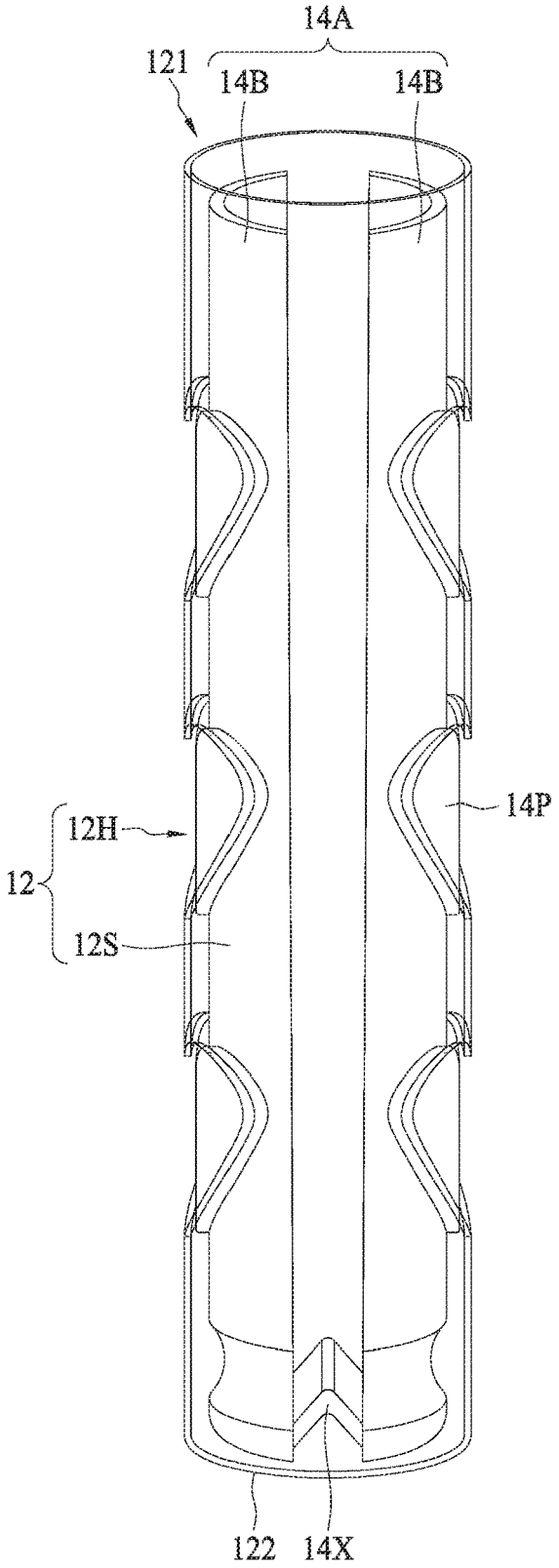
FIG. 5A, FIG. 5B and FIG. 5C are schematic diagrams illustrating a method for assembling a housing of a cosmetic container in accordance with some embodiments of the present disclosure.
Figure 5B:
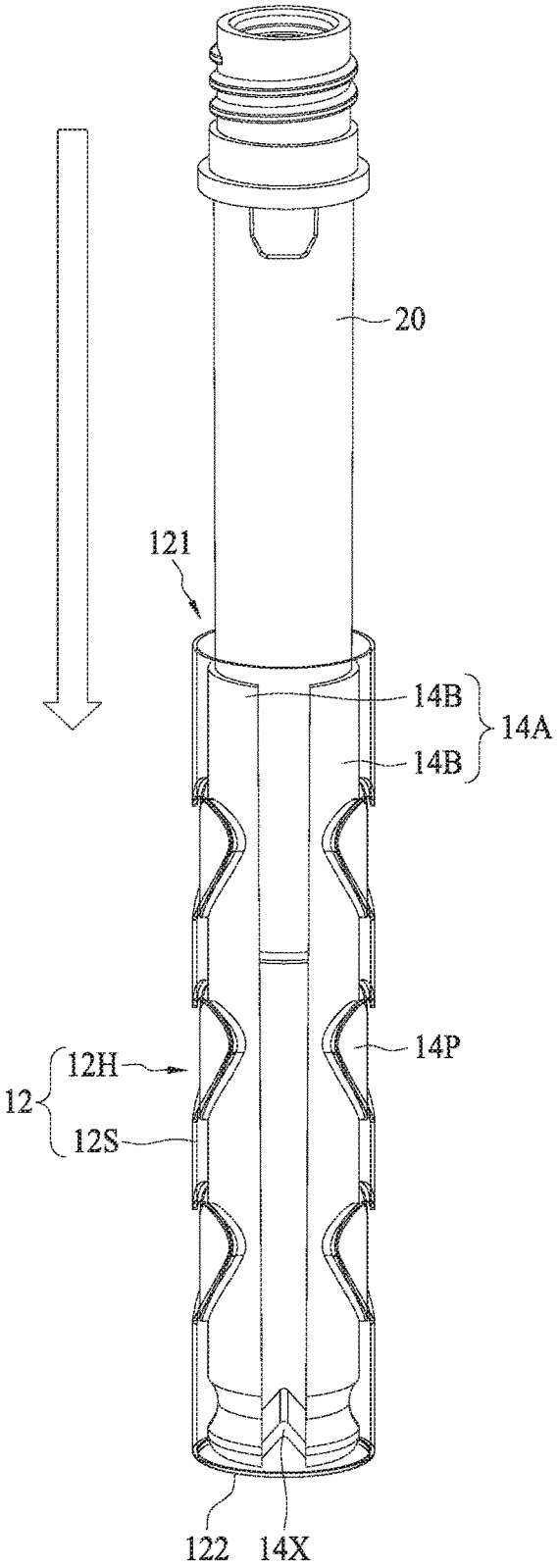
Figure 5C:
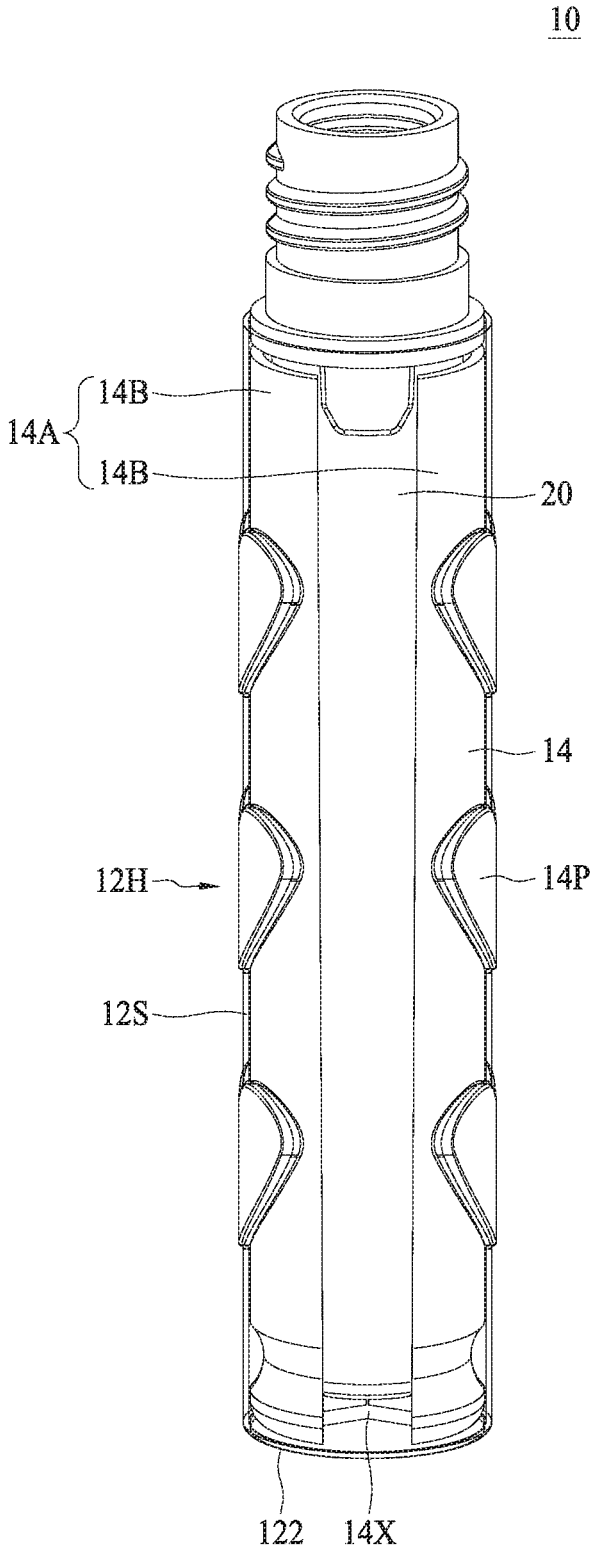

FIG. 5A, FIG. 5B and FIG. 5C are schematic diagrams illustrating a method for assembling a housing of a cosmetic container in accordance with some embodiments of the present disclosure. As shown in FIG. 5A, the resilient section 14X is compressed to reduce the size of the inner shell 14 such that the inner shell 14 can be inserted into the outer shell 12. As shown in FIG. 5B, the bottle 20 is then inserted into the inner shell 14. As shown in FIG. 5C, after the bottle 20 reaches the resilient section 14X, the body sections 14B of the inner shell 14 are expanded by the bottle 20 such that the protruding patterns 14P can protrude into the perforated holes 12H of the outer shell 12. Accordingly, the housing 10 is formed.

In some embodiments of the present disclosure, the cosmetic container 1 includes the outer shell 12 and the inner shell 14 engaged with each other. The protruding patterns 14P of the inner shell 14 exposed through the perforated holes 12H of the outer shell 12 can produce desired visual and/or texturing effect, which improves quality, aesthetics and value of the cosmetic container 1.

The cosmetic container of the present disclosure is not limited to the above-mentioned embodiments, and may have other different embodiments. To simplify the description, and for the convenience of comparison between each of the embodiments of the present disclosure, the identical components in each of the following embodiments are marked with identical numerals. In order to facilitate comparing differences between the embodiments, the following description will detail the dissimilarities among different embodiments and the identical features will not be redundantly described.

Figure 6:
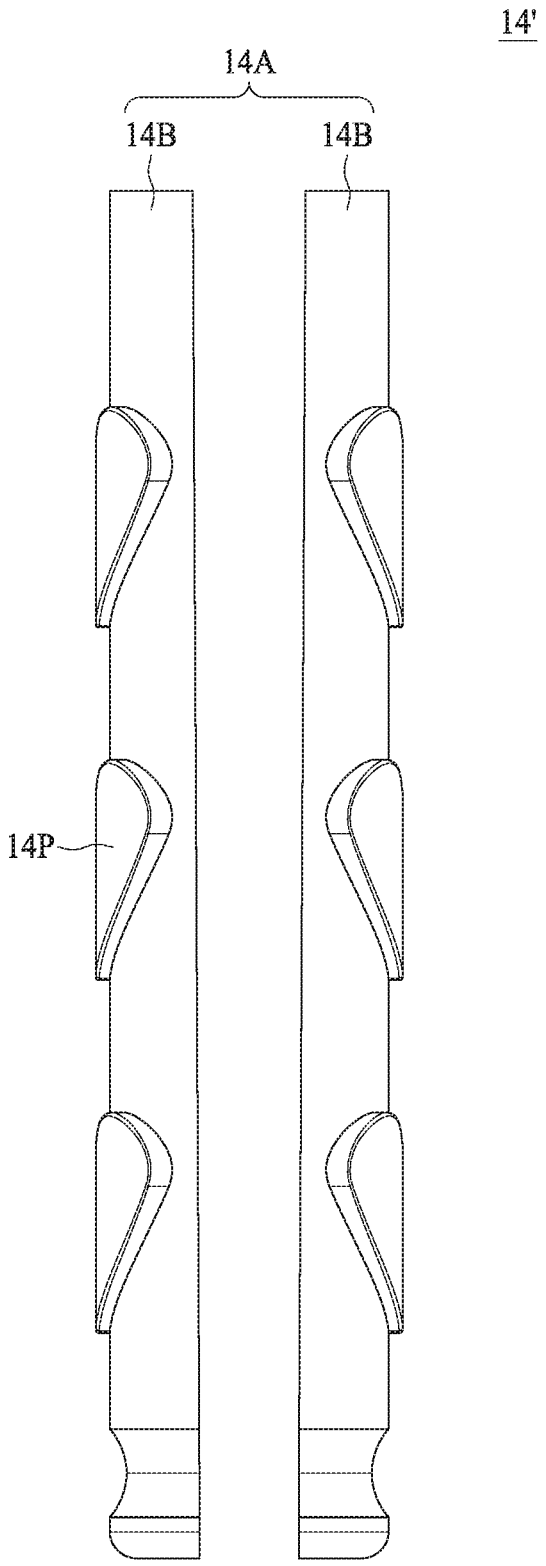
FIG. 6 is a schematic side view of an inner shell in accordance with some embodiments of the present disclosure.

FIG. 6 is a schematic side view of an inner shell in accordance with some embodiments of the present disclosure. As shown in FIG. 6, in contrast to the inner shell 14 of FIG. 3, the body 14A of the inner shell 14' is a multi-piece body such as a two-piece body. The body 14A of the inner shell 14' may include a plurality of body sections 14B with the protruding patterns 14P formed thereon, and the plurality of body sections 14B are separated from each other.

Figure 7:
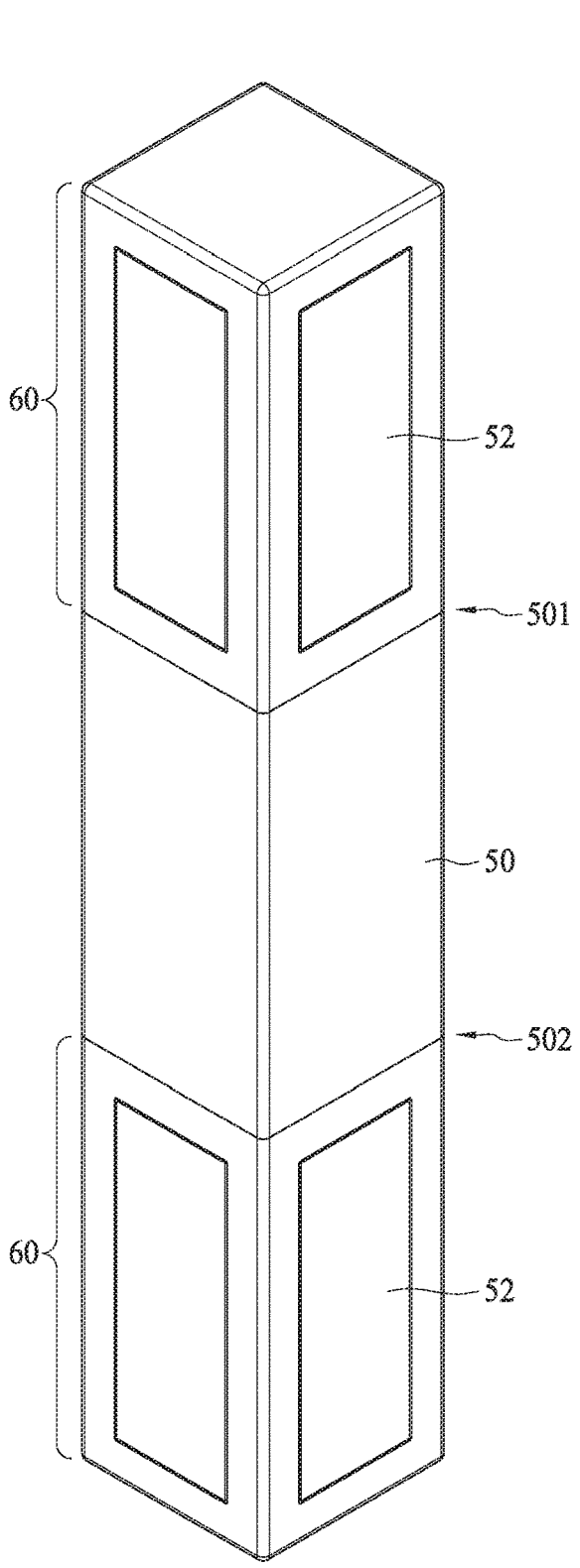
FIG. 7 is a schematic perspective view of a cosmetic container in accordance with some embodiments of the present disclosure.
Figure 7A:
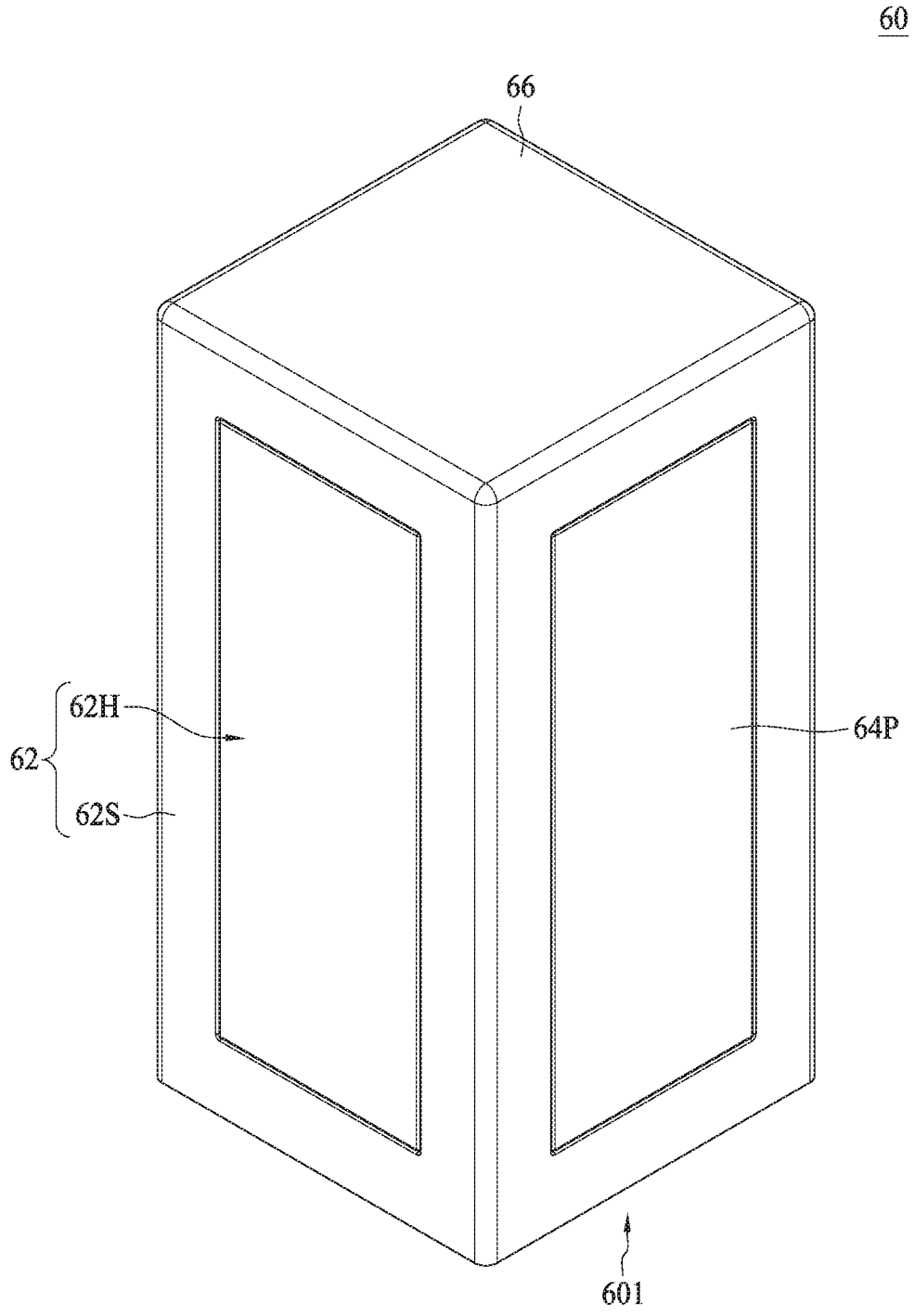
FIG. 7A is a schematic perspective view of a cap of a cosmetic container in accordance with some embodiments of the present disclosure.
Figure 7B:
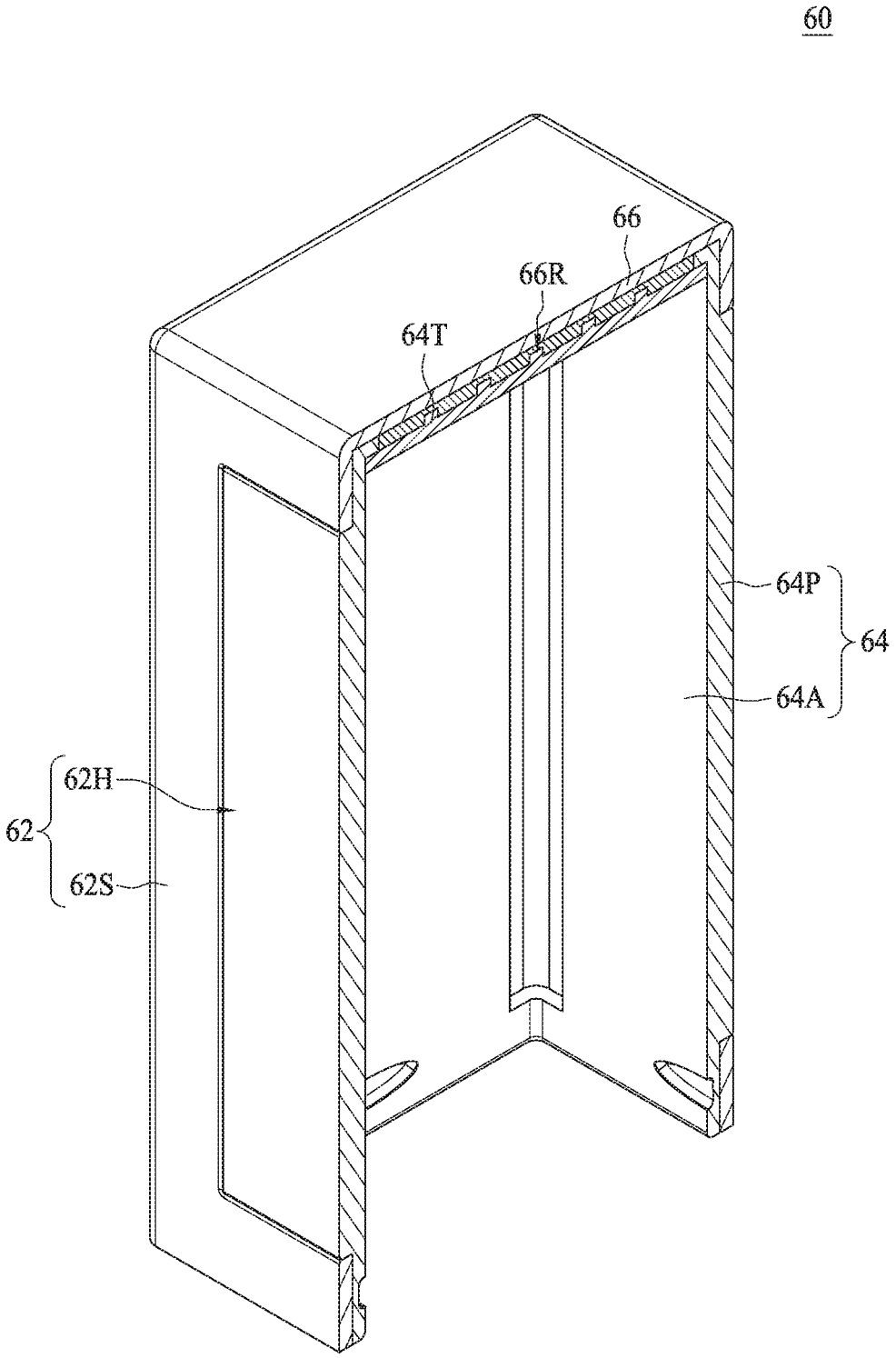
FIG. 7B is a schematic cross-sectional view of a cap of a cosmetic container in accordance with some embodiments of the present disclosure.
Figure 7C:
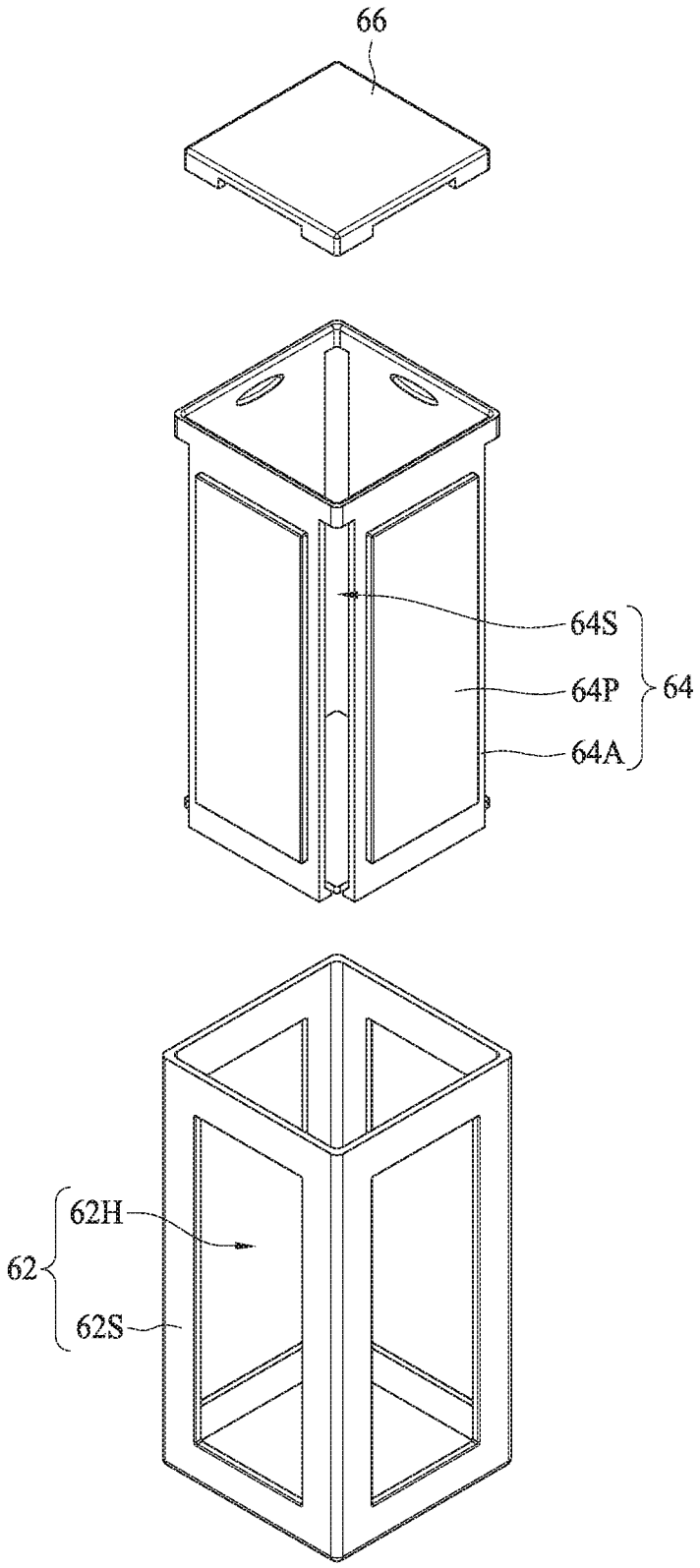
FIG. 7C is a schematic exploded view of a cap of a cosmetic container in accordance with some embodiments of the present disclosure.

Referring to FIG. 7, FIG. 7A, FIG. 7B and FIG. 7C, FIG. 7 is a schematic perspective view of a cosmetic container in accordance with some embodiments of the present disclosure; FIG. 7A is a schematic perspective view of a cap of a cosmetic container in accordance with some embodiments of the present disclosure; FIG. 7B is a schematic cross-sectional view of a cap of a cosmetic container in accordance with some embodiments of the present disclosure; and FIG. 7C is a schematic exploded view of a cap of a cosmetic container in accordance with some embodiments of the present disclosure. The cosmetic container 2 is a double-headed cosmetic container, which includes a base 50 and two caps 60. The base 50 has a first open end 501 and a second open end 502 opposite to each other for receiving two cosmetic products 52. In some embodiments, the cosmetic products 52 may include lipstick or the like.

The two caps 60 are configured to cover the first open end 501 and the second open end 502 of the base 50, respectively. In some embodiments, each of the two caps 60 has an open end 601. The open ends 601 of the two caps 60 can be detachably engageable with the first open end 501 and the second open end 502 of the base 50, respectively. In some embodiments, each cap 60 may include an outer shell 62 and an inner shell 64. The outer shell 62 includes a sidewall 62S, and the sidewall 62S includes a plurality of perforated holes 62H. The inner shell 64 can be inserted into the outer shell 62. In some embodiments, the inner shell 64 includes a body 64A and a plurality of protruding patterns 64P extending outwardly and exposed through the perforated holes 62H. The shape and number of the protruding patterns 64P are identical to those of the perforated holes 62H such that the protruding patterns 64P of the inner shell 64 can protrude into and engage with the perforated holes 62H of the outer shell 62. By way of example, the shape of the protruding pattern 64P may be rectangular shape, but is not limited thereto.

In some embodiments, the outer shell 62 and the inner shell 64 are formed from different materials to produce a desired visual effect. In some embodiments, the material of the outer shell 62 may be formed from an opaque material such as aluminum or other metal material. In some embodiments, the material of the inner shell 64 may be formed from a transparent material or an opaque material. For example, the material of the inner shell 64 may include plastic. The transparent material allows the customer to see the cosmetic product 52 when the base 50 is capped by the cap 60. In some embodiments, the outer shell 62 and the inner shell 64 may have different colors to produce a desired visual effect. In some embodiments, the protruding patterns 64P of the inner shell 64 may be formed from a fluorescent or a phosphorous material to produce a glimmer visual effect. In some embodiments, the protruding patterns 64P of the inner shell 64 may be formed from an optical material to produce a three-dimensional (3D) visual effect. In some embodiments, the inner shell 64 may be replaceable such that the customer can select a different inner shell 64 to meet different requirements. For example, the customer can select different inner shells 64 to fit the customer's outfit or accessories. In some embodiments, the height of the protruding patterns 64P may be identical to the depth of the perforated holes 62H such that the outer surface of the sidewall 62S of the outer shell 62 and the outer surfaces of the protruding patterns 64P of the inner shell 64 are coplanar so as to avoid injury and provide comfortable texture. In some alternative embodiments, the height of the protruding patterns 64P may be larger than the depth of the perforated holes 62H such that the outer surfaces of the protruding patterns 64P of the inner shell 64 may be protruded out from the outer surface of the sidewall 62S of the outer shell 62 so as to provide a desired visual effect.

In some embodiments, each cap 60 may further include a cover plate 66 affixed to the outer shell 62 and the inner shell 64. The cover plate 66 may form a closed end in the cap 60. In some embodiments, the cover plate 66 may be formed from a resilient material such as plastic. In some embodiments, the cover plate 66 may include a plurality of recesses 66R, and the inner shell 64 may include a plurality of projections 64T engaged with the recesses 66R of the cover plate 66 such that the cover plate 66 may be affixed to the inner shell 64. In some embodiments, the cover plate 66 may be affixed to the outer shell 62 with adhesives such as glues to enhance adhesion between the cover plate 66 and the outer shell 62.

In some embodiments, the inner shell 64 is formed from a resilient material, and the inner shell 64 may include a plurality of slots 64S. The slots 64S are configured to reduce a size of the inner shell 64 such that the inner shell 64 may be squeezed for fitting the inner shell 64 to the outer shell 62.

Figure 8A:
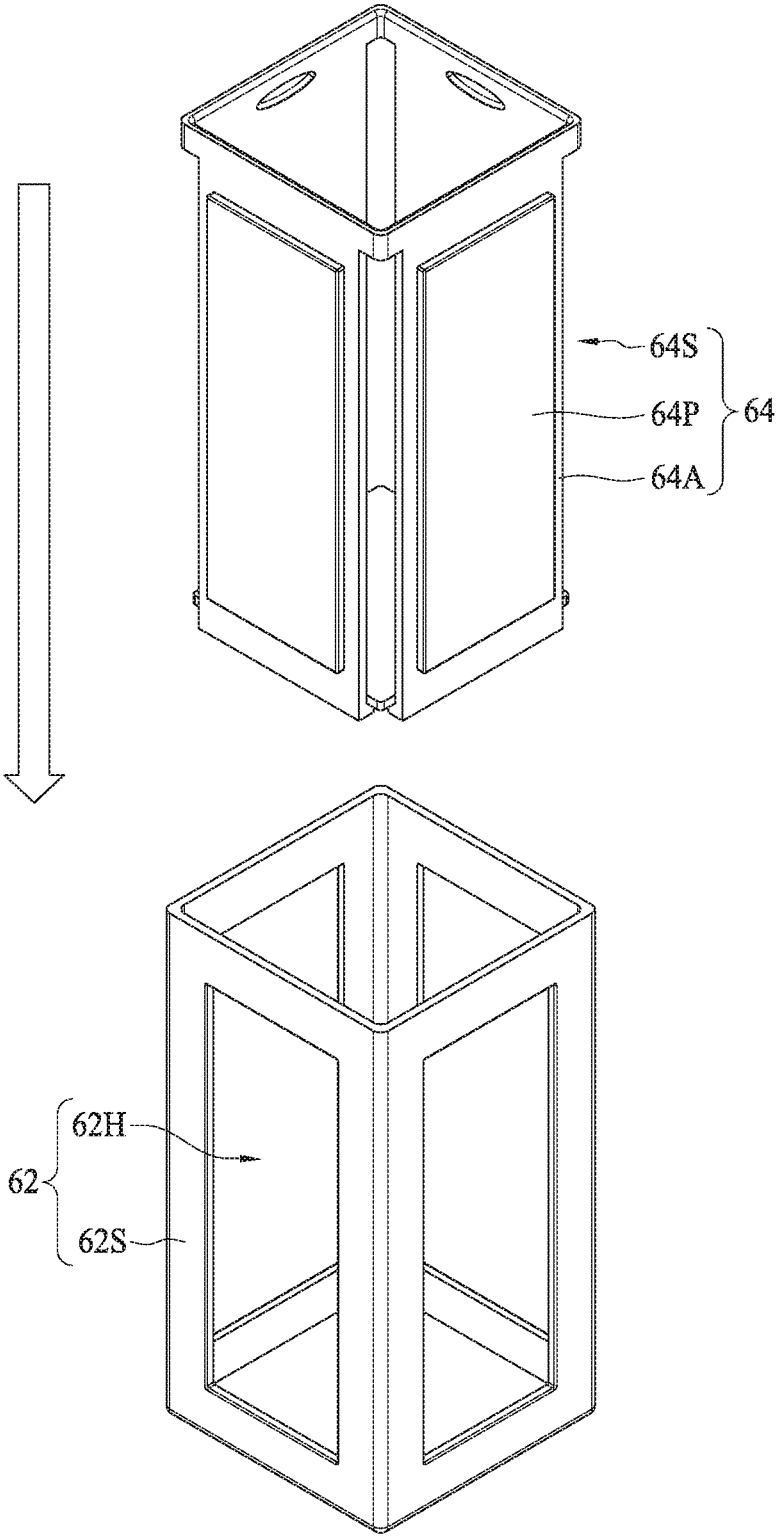
FIG. 8A, FIG. 8B and FIG. 8C are schematic diagrams illustrating a method for assembling a housing of a cosmetic container in accordance with some embodiments of the present disclosure.
Figure 8B:
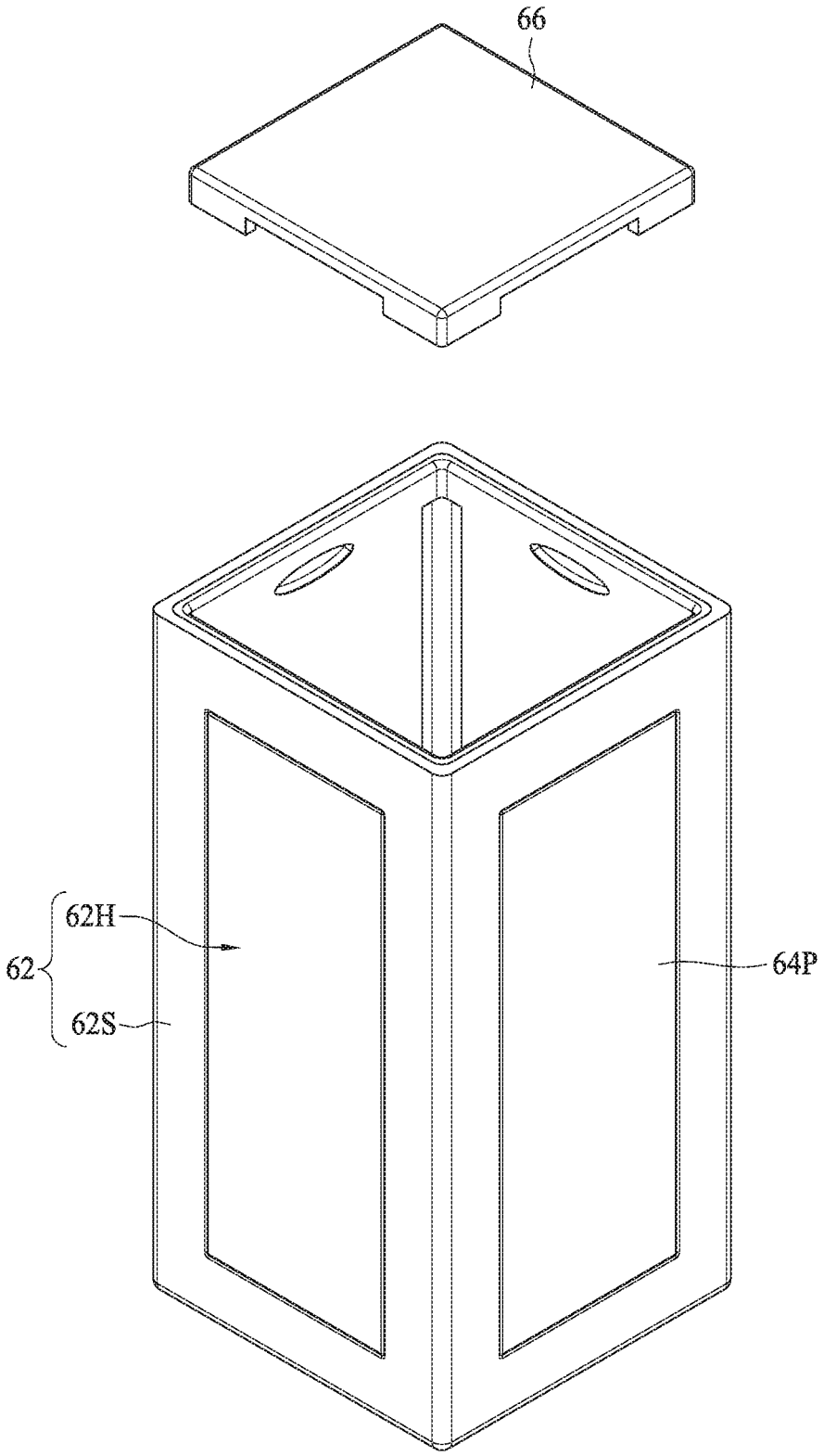
Figure 8C:
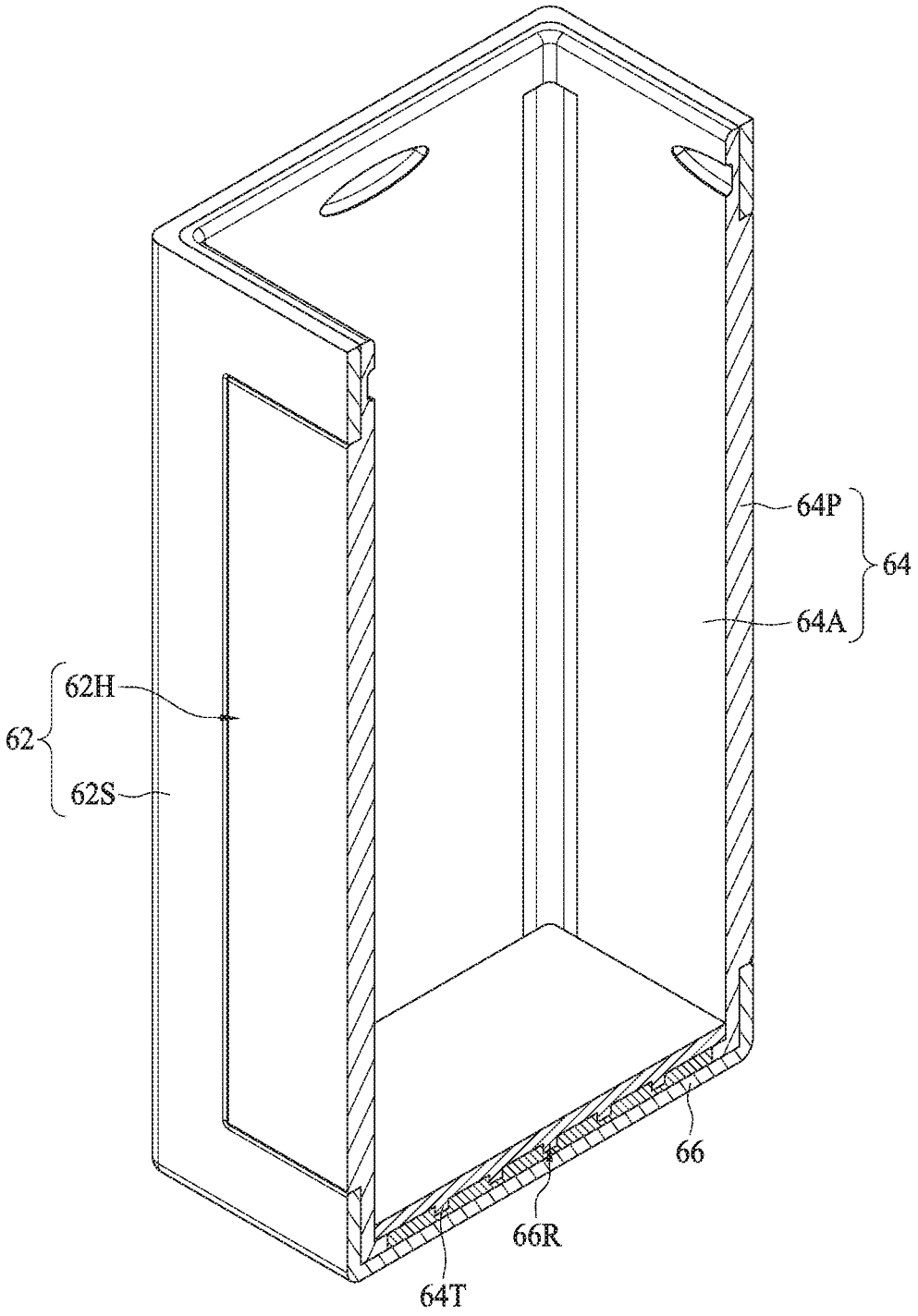

FIG. 8A, FIG. 8B and FIG. 8C are schematic diagrams illustrating a method for assembling a housing of a cosmetic container in accordance with some embodiments of the present disclosure. As shown in FIG. 8A, the inner shell 64 with the slots 64S may be squeezed so that the size of the inner shell 64 can be reduced and inserted into the outer shell 62. As shown in FIG. 8B, after the inner shell 64 is inserted into the outer shell 62, the inner shell 64 can restore to its original size such that the protruding patterns 64P engage with the perforated holes 62H of the outer shell 62. As shown in FIG. 8C, the cover plate 66 is then affixed to the inner shell 64 and the outer shell 62. In some embodiments, the cover plate 66 may be affixed to the outer shell 62 with adhesives such as glues to enhance adhesion between the cover plate 66 and the outer shell 62.

In conclusion, the cosmetic container of the present disclosure includes an outer shell and an inner shell engaged with each other to expose the protruding patterns of the inner shell through the perforated holes of the outer shell. The material of the protruding patterns is different from that of the outer shell, and thus can provide desired visual and texturing effects. For example, the protruding patterns can provide transparency effect, coloring effect, glimmer effect, 3D visual effect or the like. The outer surfaces of the protruding patterns and the outer shell may be coplanar to avoid injury and provide comfortable texture. The cosmetic container of the present disclosure has improved quality, aesthetics and value, and is able to match the outfit and accessories of the customer.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A cosmetic container, comprising:

a housing comprising:

an outer shell comprising a sidewall, wherein the sidewall includes a plurality of perforated holes;

an inner shell inserted into the outer shell, wherein the inner shell includes a body and a plurality of protruding patterns extending outwardly and exposed through the perforated holes; and a bottle inserted into the inner shell, wherein the body of the inner shell is expanded by the bottle such that the protruding patterns of the inner shell protrude into and engage with the perforated holes, wherein the bottle is bonded to the sidewall of the outer shell.

2. The cosmetic container of claim 1, wherein an outer surface of the sidewall of the outer shell and outer surfaces of the protruding patterns of the inner shell are coplanar.

3. The cosmetic container of claim 1, wherein outer surfaces of the protruding patterns of the inner shell protrude out from an outer surface of the sidewall of the outer shell.

4. The cosmetic container of claim 1, wherein the bottle is bonded to the body of the inner shell.

5. The cosmetic container of claim 4, wherein the bottle is bonded to the body of the inner shell by ultrasonic welding.

6. The cosmetic container of claim 1, wherein the bottle is bonded to the sidewall of the outer shell by ultrasonic welding.

7. The cosmetic container of claim 1, wherein the body of the inner shell is a one-piece body comprising a plurality of body sections with the protruding patterns formed thereon, and a resilient section between and connected to the body sections.

8. The cosmetic container of claim 7, wherein the resilient section comprises a herringbone-pleated structure.

9. The cosmetic container of claim 1, wherein the body of the inner shell is a multi-piece body comprising a plurality of body sections with the protruding patterns for lied thereon, and the plurality of body sections are separated from each other.

10. The cosmetic container of claim 1, wherein the outer shell and the inner shell are formed from different materials.

11. A cosmetic container, comprising:

a base having a first open end and a second open end opposite to each other for receiving separate cosmetic products; and two caps configured to cover the first open end and the second open end of the base, respectively, each of the two caps having an open end, the open ends of the two caps being detachably engageable with the first open end and the second open end of the base, respectively, wherein each of the two caps comprises:

an outer shell comprising a sidewall, wherein the sidewall includes a plurality of perforated holes; and an inner shell inserted into the outer shell, wherein the inner shell includes a body and a plurality of protruding patterns extending outwardly and exposed through the perforated holes;

wherein each of the two caps further comprises a cover plate affixed to the outer shell and the inner shell, forming a closed end in the cap.

12. The cosmetic container of claim 11, wherein an outer surface of the sidewall of the outer shell and outer surfaces of the protruding patterns of the inner shell of each of the two caps are coplanar.

13. The cosmetic container of claim 11, wherein outer surfaces of the protruding patterns of the inner shell of each of the two caps protrude out from an outer surface of the sidewall of the outer shell.

14. The cosmetic container of claim 11, wherein each of the cover plates includes a plurality of recesses, and each of the inner shells includes a plurality of projections engaged with the recesses of the cover plate such that each of the cover plates is affixed to the inner shell.

15. The cosmetic container of claim 11, wherein each of the cover plates is affixed to the respective outer shell with adhesives.

16. The cosmetic container of claim 11, wherein the outer shell and the inner shell are formed from different materials.

17. The cosmetic container of claim 11, wherein the inner shell is formed from a plastic, and the inner shell includes a plurality of slots configured to reduce a size of the inner shell for fitting the inner shell into the outer shell.

* * * * *